United States Patent [19]

Andersen

[11] 4,292,616

[45] Sep. 29, 1981

[54] COMBINED TOGGLE SWITCH AND FRONT ACCESS FUSE HOLDER

[76] Inventor: James H. Andersen, 8005 E. Mercer Way, Mercer Island, Wash. 98040

[21] Appl. No.: 137,806

[22] Filed: Apr. 4, 1980

[51] Int. Cl.[3] ..... H01H 85/00

[52] U.S. Cl. ..... 337/4; 337/8; 337/143

[58] Field of Search ..... 337/4, 5, 6, 7, 8, 9, 337/143, 299, 401; 339/147; 200/6; 335/142

[56] References Cited

U.S. PATENT DOCUMENTS

| | | | |
|---|---|---|---|
| 1,532,235 | 4/1925 | Dexter | 337/9 |
| 2,124,275 | 7/1938 | Rowe | 337/8 |
| 2,144,139 | 1/1939 | Batcheller | 337/143 |
| 2,905,789 | 9/1959 | Earle | 337/8 |
| 3,480,898 | 11/1969 | Giegerich | 337/4 |

*Primary Examiner*—Harold Broome

*Attorney, Agent, or Firm*—Christensen, O'Connor, Johnson & Kindness

[57] ABSTRACT

A combined cartridge fuse holder and switch incorporates the cartridge fuse as part of the switching mechanism. One end of the cartridge fuse is pivoted about a fulcrum contact coupled to a first terminal. A switch assembly swings the other end of the cartridge fuse transversely relative to the fuse axis to make and break contact with a contact on a second terminal.

18 Claims, 8 Drawing Figures

COMBINED TOGGLE SWITCH AND FRONT ACCESS FUSE HOLDER

BACKGROUND OF THE INVENTION

The present invention relates generally to electrical switches, more particularly to a combination fuse holder and switch, and in its preferred form, a combination cartridge fuse holder and switch mechanism of the type that can be panel mounted and that is accessible from the front side of the panel and switch for fuse replacement.

Cartridge fuses are normally employed in many electrical circuits, especially those employed in automobiles, boats, and other low voltage applications. Cartridge fuses are also utilized in normal house current circuits for protection of electrical components such as those employed in radios and televisions. Normally, cartridge fuses of the type having a glass tube housing a fuse link with ferrule contacts at each end are mounted in separate fuse holders and are coupled in series with an electrical circuit to be protected. In many applications such as in automobiles and boats, a separate fuse panel centralizes the location of the fuses for the several circuits employed. Commonly, such fuse panels are tucked into niches that are often at the very least difficult to access. Furthermore, because of the limited space, the labelling of the various fuses is cryptic and sometimes nonexistent, thus making it difficult to locate a given fuse that is coupled to a particular circuit. Additionally, a separate fuse panel takes up space that might otherwise be put to a more valuable use. Costly wiring is also required between the panel switches and the fuse panel.

It is therefore a broad object of the present invention to provide a fuse holder that is easily accessible and is easily identifiable with a given circuit. It is a further object of the present invention to combine the functions of a fuse holder and a switch so that the prior art fuse panels can be eliminated. Further objects of the present invention are to provide a combined cartridge fuse holder and switch that is relatively inexpensive to manufacture, that is relatively easy to install and connect into a circuit, that places the cartridge fuse in a position for easy accessibility, and that is foolproof in operation and virtually indestructible. Importantly, it is also an object of the present invention to provide a switch and fuse holder that occupies little space and eliminates expensive switch-to-fuse panel wiring.

SUMMARY OF THE INVENTION

Accordingly, the foregoing objects and other objects that will become apparent to one of ordinary skill in the art, are achieved by the present invention which provides a combination fuse holder and switch comprising a body means, a switch means, and a holder means for coupling the switch means to the body means. The body means includes a first receptacle means for receiving one contact end of an elongated fuse. The body means defines a channel communicating between said first receptacle means and an opening in the body means. A first terminal has a first contact in the first receptacle. A second terminal has an arm extending into the channel in the body means. The arm has a second contact thereon located in the channel and spaced from the first contact. The switch means includes a second receptacle means for retentively receiving the second contact end of the fuse. The switch means moves the second receptacle means transversely relative to the longitudinal axis of the fuse. A means is also provided for placing the second contact end of the fuse in electrical contact with an exterior contact on the second receptacle means. The holder means holds the switch means and couples the switch means to the body means so that the first contact end of the fuse is in electrical contact with the contact in the first receptacle means. The contact on the second terminal arm is positioned relative to the exterior contact on the second receptacle means so that the two contacts can make and break electrical contact when the second receptacle means is moved by said switch means transversely relative to the fuse axis and toward and away from the contact on the terminal arm.

BRIEF DESCRIPTION OF THE DRAWINGS

A better understanding of the present invention can be derived by reading the ensuing specification in conjunction with the accompanying drawings wherein.

DETAILED DESCRIPTION OF THE INVENTION

Figures 1, 2, 3, 4:
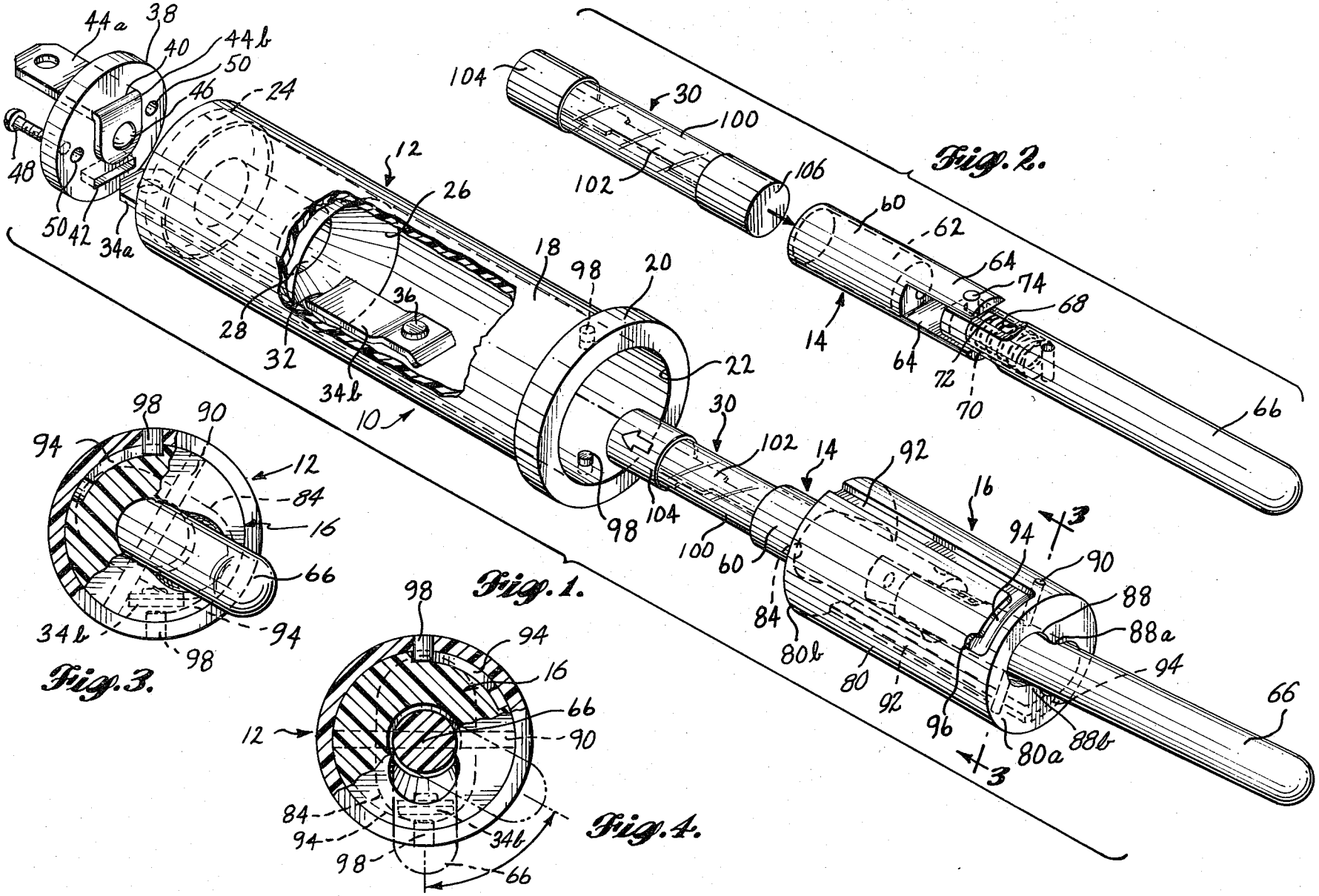
FIG. 1 is an exploded isometric view of the combination cartridge fuse holder and switch assembly of the present invention.
FIG. 2 is an exploded isometric view of the switch assembly of the present invention and a cartridge fuse.
FIGS. 3 and 4 are partial cross-sectional views taken along section line 3—3 of FIG. 1 showing the positioning of the switch holder relative to a terminal arm in the body when the switch assembly, a fuse and the switch holder are being inserted into the body.
Figures 5, 6, 7, 8:
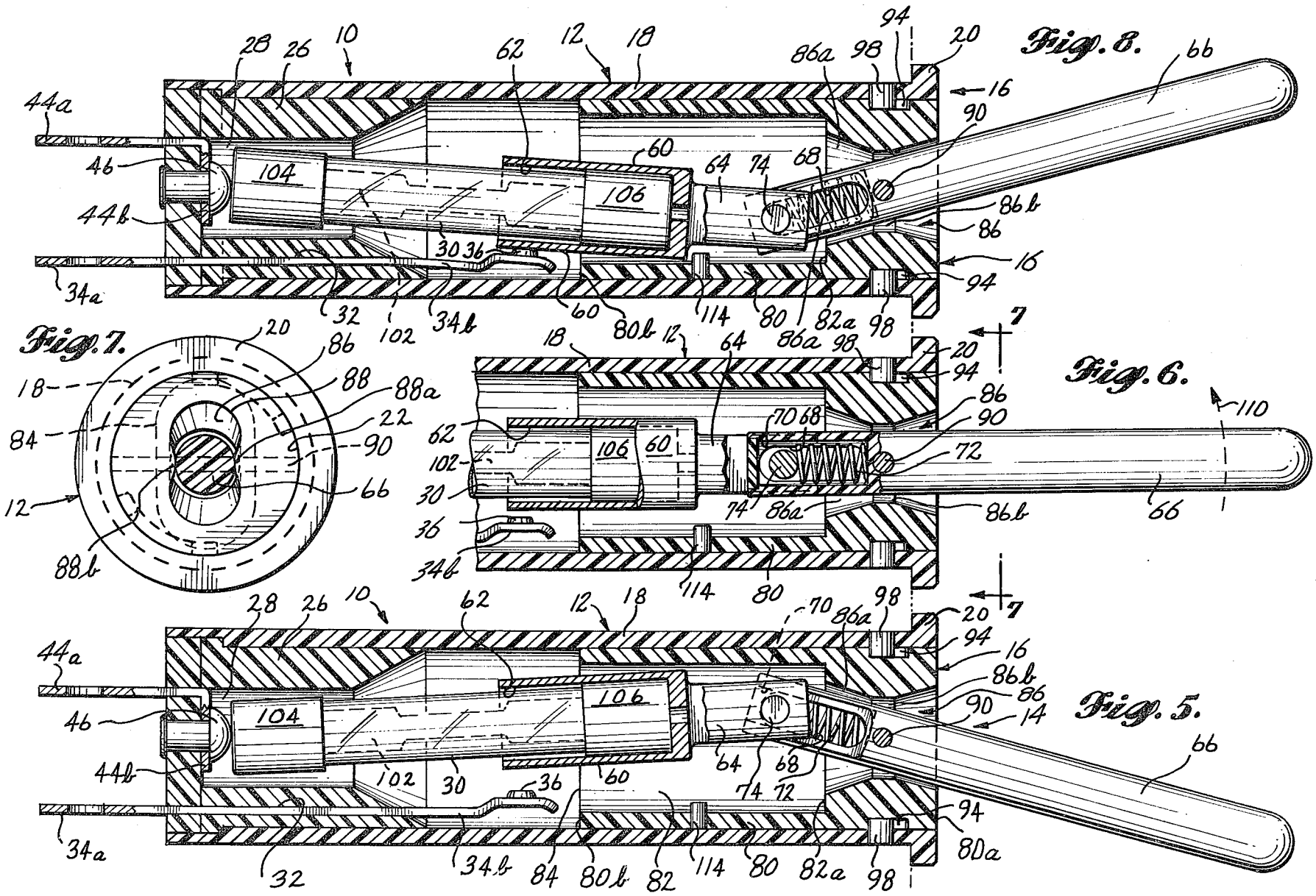
FIG. 5 is a longitudinal sectional view illustrating the switch assembly in the OFF position.
FIG. 6 is a segment of a longitudinal sectional view similar to FIG. 5 showing the switch assembly in a neutral position.
FIG. 7 is a sectional view taken along section line 7—7 of FIG. 6.
FIG. 8 is a longitudinal sectional view illustrating the switch assembly in the ON position.

Referring first to FIGS. 1, 2, and 5, the combined fuse holder and switch 10 of the present invention has three major subassemblies, a main body 12, a switch assembly 14, and a switch holder 16. The body 12 is formed from a tubular case 18 having a radially outwardly extending shoulder 20 at one end surrounding a circular opening 22 and a circular opening 24 at the other end. The interior of the tubular case 18 forms a cylindrical cavity. A cylindrical insert 26 is positioned in the cylindrical cavity adjacent the circular opening 24, and in the illustrated embodiment is adhesively secured to the tubular case 18. The cylindrical insert 26 has an axial bore forming a receptacle 28 for one end of a cartridge fuse 30. The cylindrical insert extends axially from adjacent the circular opening 24 less than halfway into the case 18. The cylindrical insert also carries a longitudinal slot 32 running parallel to the receptacle 28 and positioned adjacent the outer periphery of the cylindrical insert. The elongated slot 32 carries an elongated terminal 34 having a terminal end **34*a* that extends longitudinally beyond the circular opening 24 of the case 18. The other end of the terminal 34 extends longitudinally beyond the cylindrical insert 26, exposing a flexible and resilient arm 34*b* that is positioned off center from the cylindrical bore within the case 18. The arm 34*b* carries a radially inwardly facing contact 36. The contact 36 thus places the interior of the body 12 in electrical contact with the exterior of the cavity via the exterior end 34***a* of the terminal 34.

An end cap 38 is circular in configuration and has a diameter equivalent to that of the circular opening 24 in the end of the case 12. The end cap 38 is positioned inside and adhesively secured to the tubular case 18 adjacent the opening 24. The end cap 38 carries a pair of slots 40 and 42. The slot 42 is aligned with the slot 32 in the cylindrical insert so that the exterior end 34*a* of the elongated terminal extends through the slot 42 when the end cap 38 is positioned in the circular opening 24. The second slot 40 receives a short terminal 44 that is L-shaped in configuration. A long arm 44*a* of the terminal 44 extends through the slot 40 in generally parallel relationship with the exterior end 34*a* of terminal 34. A short arm 44*b* of terminal 44 extends inwardly to a location adjacent the center of the end cap 38. The short arm 44*a* carries a raised contact 46 positioned centrally relative to the end cap and thus axially relative to the case 12. The contact 46 extends into and is centered in the axial bore of the receptacle 28 when the end cap is in position. A pair of fasteners 48 (only one of which is illustrated) extends through openings 50 and into aligned openings (not shown) in the cylindrical insert 26 to fasten the end cap in place. It should be noted at this juncture that the main body 12 can and most preferably would be a unitary structure including the tubular case 18, the cylindrical insert 26 and the end cap 38. In the latter event, the fasteners 48 would, of course, be eliminated.

The switch assembly 14 includes a cylindrical fuse receptacle 60 having a cyindrical bore that forms a second cavity 62 for receiving the other end of a cartridge fuse 30. The fuse receptacle 60 is preferably composed of an electricaliy conductive material so that the outside surface of the receptacle is in electrical contact with the ferrule contact of a fuse inserted into cavity 62. A pair of arms 64 extending longitudinally from one end of the fuse receptacle 60 opposite the end having the cavity opening form a yoke to which an elongated switch arm 66 is connected. The switch arm 66 carries an internal, axially extending bore 70 that opens onto the end of the arm adjacent the fuse receptacle. The switch arm 66 has a longitudinally and diametrically extending slot 68 adjacent the same end that intersects the bore 70. A compression spring 72 is positioned in the bore 70 and a pivot pin 74 is positioned in the slot 68 so that compression spring 72 biases the pivot pin toward the end of the switch arm 66. The pivot pin 74 extends beyond the sides of the switch arm 66 and into mutually aligned openings in the yoke formed by arms 64 on the fuse receptacle 60. Thus, the switch arm 66 is pivotally coupled to the fuse receptacle 60 by the pivot pin 74. The function of the biasing assembly formed by the slot 68, bore 70, compression spring 72, and the pivot pin 74 will be described in more detail later.

Referring conjunctively to FIGS. 1 and 8, the switch holder 16 has a generally cylindrically shaped body 80. The diameter of the body 80 is slightly less than the diameter of the cylindrical cavity in the case 18. The body 80 has an inwardly opening cavity 82 that is elongated in a diametric direction and opens in the form of an oval-shaped opening 84 having a major axis extending along a diameter of the cylindrical body 80 and a minor axis extending orthogonally to the major axis along another diameter of the cylindrical body 80. The cavity 82 terminates short of the outside end 80*a* of the body 80. The inner end of the cavity 82 communicates with the outer end 80*a* of the body 80 by a channel 86. The channel 86 has a first portion 86*a* that is elongated in the same general diametric direction as the cavity 82 but diverges toward a circular, central portion 86*b* located about halfway between the inner end 82*a* of the elongated cavity 82 and the outer end 80*a* of the cylindrical body. The channel 86 then again flares outwardly to a dumbbell-shaped opening 88 on the outer end 80*a* of the body 80. The central, side portions 88*a* and 88*b* of the dumbbell-shaped opening are positioned along a diameter that is generaly parallel to the minor axis of the cavity 82 and are spaced from each other by a distance slightly less than the diameter of switch arm 66. The central portions 88*a* and 88*b* thus offer resistance to motion of the switch arm across the center position to assist in retaining the arm in each of the OFF and ON positions described below.

The switch arm 66 is pivotally mounted to the cylindrical body 80 by a pivot pin 90 that extends through a diametric bore in the cylindrical body 80 that is oriented parallel to the minor axis of the cavity 82 and through a mutually aligned bore in the switch arm 66 that is parallel to the pivot pin 74 coupling the switch arm 66 to the fuse receptacle 60. When assembled, the outer end of the switch arm 66 extends through the dumbbell-shaped opening 88 in the outer end 80*a* of the switch body 80. The inner fuse-receiving end of the fuse receptacle 60 extends slightly beyond the inner end 80*b* of the cylindrical body 80. The remaining portion of the switch assembly 14, including the biasing assembly previously described, is housed within the elongated cavity 82.

The body 80 of the switch holder 16 also carries a pair of diametrically opposed longitudinally extending guide grooves 92 extending from the inner end 80*b* of the body longitudinally to adjacent the outer end 80*a* of the body. The portion of the grooves 92 adjacent the outer end 80*a* of the body 80 are joined to circumferential guide grooves 94 that terminate in detents 96. The detents 96 extend away from the outer end 80*a* of the body 80. The detents are also located opposite from each other generally along a diameter parallel to the major dimension of the cavity 82. The longitudinal guide grooves 92 are angularly offset from the major dimension of the cavity 82. The guide grooves 92 mate with guide pins 98 mounted in the shoulder 20 on the body 12. The guide pins extend inwardly into the cylindrical cavity formed within the tubular case 18 adjacent the opening 22. The pins 98 are positioned generally along a diametral plane that intersects the contact 36 on the terminal arm 34*b*.

Referring now to FIGS. 1 and 3, when a cartridge fuse 30 is inserted into the fuse receptacle 60 and the switchholder 16, switch assembly 14, and fuse 30 are inserted into the body 12, the guide grooves 92 and guide pins 98 must be aligned. When the grooves and pins are aligned and the holder 16 is telescoped into the cylindrical cavity in the case 18, the major axis of the cavity 82 (and the cavity opening 84) will be oriented transversely to the diametral plane on which the pins 98 are mounted. Thus, the fuse 30 and fuse receptacle 60 will be angularly offset from the contact 36 on the terminal arm 34*b* as shown in FIG. 3. Thus, even though the fuse receptacle 60 and fuse 30 are free to swing about pivot pin 74 during insertion, the geometry of the cavity 82 (and cavity opening 84) in conjunction with the angular offset produced by the coaction of guide pins 98 and longitudinal guide grooves 92 will prevent the fuse and/or fuse receptacle from contacting and damaging the arm 34*b* during insertion of the switch holder 16 into the body 12. The end of the cylindrical insert 26 nearest the arm 34*b* has a flared or frustoconically shaped entrance opening that is convergent in a rearward direction from the interior surface of the tubular case 18 toward the cylindrical receptacle 28. Thus, as the holder 16, switch assembly 14 and fuse 30 are inserted into the body, the leading portion of the fuse (ferrule contact 104) contacts the flared entrance opening and is guided into the fuse receptacle 28. After the holder 16 is fully inserted into the body 12, the guide pins 98 encounter the circumferential grooves 94. Thereafter, the holder 16 is rotated relative to the body 12, causing the pins to traverse circumferential grooves 94 and bringing the pins into contact with the detent 96 as shown in FIGS. 4 and 5. In this position, the major axis of the cavity 82 (and opening 84) is brought into alignment with the diametral plane intersecting the pins 98 and the contact 36 on the terminal arm 34*b*.

To remove the holder 16 and switch assembly 14, to, for example, replace a blown fuse, the holder is simply pushed inwardly relative to the body 12 until the pins 98 clear detents 96. The holder is then rotated until the pins 98 engage the longitudinal slots 92. Thereafter, the holder and switch assembly are separated from the body 12 by pulling the holder axially from the case 18.

At this point it will be noted that the fuse 30 is a conventional cartridge type having a glass tube 100 housing a fuse link 102 making internal contact with first and second ferrule contacts 104 and 106. One of the ferrule contacts 106 is inserted into the cylindrical cavity 62 in the fuse receptacle 60 prior to insertion of the switch assembly and holder into the main body 12. The cavity 62 is preferably sized to provide a tight fit for the ferrule contact, but not so tight that it becomes difficult to insert or remove the fuse from the cavity. As the fuse, switch assembly, and holder are inserted into the main body 12, the other ferrule contact 104 of the fuse extends into the cavity 28 in the cylindrical insert 26 within the case 18 and makes contact with the contact 46 on terminal 44. The dimensions of the case 18, the switch assembly 14, and switch holder 16 are chosen such that when the ferrule contact 104 makes electrical contact with the contact 46 on the terminal 44 and the guide pins 98 are in position in the detents 96, the pivot pin 74 is moved slightly against the force of the compression spring 72 so as to bias the holder 16 longitudinally outwardly relative to the body and thus hold the guide pins 98 in the detents 96.

Referring now to FIG. 5, the fuse holder and switch of the present invention are shown assembled and in an OFF position. In this position, the fuse receptacle 60 is spaced from the contact 36 on terminal arm 34*b*. As the switch arm 66 is moved upwardly toward the neutral or center position shown in FIG. 6, the inner end of the switch arm 66 swings downwardly about the pivot pin 90. As this occurs, the pivot pin 74 is forced toward the pivot pin 90, thus compressing compression spring 72. As the switch arm 66 continues to swing upwardly in the direction of arrow 110, the pivot pin 74 crosses the central longitudinal axis of the entire assembly, and begins to move in an arc away from the pivot pin 90 under the urging of compression spring 72. As the motion continues, the exterior portion of the fuse receptacle 60 comes into contact with contact 36 on terminal arm 34*b* and slightly flexes terminal arm 34 in a radially outward direction as shown in FIG. 8. In this manner, a complete circuit is made from the outer end of terminal 34 through the fuse receptacle 60 to the ferrule contact 106, through the fuse link 102 to the ferrule contact 104, and to electrical contact 46 on terminal 44.

The relationship of the pivot pins 74 and 90 and the biasing force of spring 72 act conjunctively as a toggle mechanism to bias the switch mechanism 14 toward both the ON position as illustrated in FIG. 8 and the OFF position as illustrated in FIG. 5. Referring to FIG. 7, the biasing mechanism is provided with additional resistance to movement of the switch arm 66 from an OFF position to an ON position. The radially inwardly extending, central portions 88*a* and 88*b* of the switch arm opening 88 on the body 80 are spaced by a distance slightly less than the diameter of the switch arm 66. Thus, the portions 88*a* and 88*b* offer resistance to movement as the switch arm 66 passes through its neutral position as shown in FIGS. 6 and 7 toward either of the ON or OFF positions.

Referring to FIG. 8, the holder 16 carries a stop pin 114 that extends into the elongted cavity 82 along a major axis of the cavity. The stop pin is located on the side of the cavity in which the fuse receptacle 60 is located when the switch assembly is in the ON position. The stop pin 114 is also positioned adjacent the outer end of the fuse receptacle 60. The stop pin 114 extends into the cavity 82 sufficiently far so that the inner portion of the stop pin 114 will contact the upper end of the fuse receptacle if an attempt is made to push in on the holder to remove the guide pins 98 from detents 96 when the switch is in the ON position. Likewise, full insertion and locking of the holder 16 and switch assembly 14 into the body 12 when the switch is in the ON position is not possible. Thus, the stop pin 114 makes it possible to assemble and disassemble the switch only when the switch is in the OFF position.

Other major advantages of the combined switch and fuse holder of the present invention will be apparent upon examination of the geometry and dimensional relationships of the contact arm 34*b* and contact 36 relative to contact 46 on contact arm 44, and the circular opening 22 on the body 12 in comparison with the length of the fuse 30 and spacing of the ferrule contacts 104 and 106. Specifically, the spacing between the contact 46 and the contact 36 are such that if a fuse is inadvertently dropped into the body 12 so that the ferrule contact 104 makes electrical contact with contact 46, the other ferrule contact 106 is spaced above the contact 36, thus preventing a completed electrical circuit. Similarly, if one grasps one ferrule 106 of the fuse 30, or the fuse receptacle 60 when a fuse is in the receptacle, and inserts the fuse in the body opening 22, the spacing between the opening 22 and arm 34*b* is such that no contact is made with the other ferrule 104, thus preventing inadvertent formation of an electrical circuit to ground through a person's body.

One of ordinary skill will be able to see that the present invention does fulfill the objects set forth in the Background of the Invention. One of ordinary skill will also be able to effect various changes, substitutions of equivalents, and other alterations without departing from the broad concepts imparted herein. For example, with the addition of a third terminal similar to terminal 34, the switch could easily be modified to a center OFF position with two ON positions. Of course, to modify the disclosed switch from a two-position to a three-position switch would require other minor modifications to the structure, including a modification of the dumbbell-shaped opening 88 to provide for holding the switch arm 66 in a center OFF position. Additionally, the additional resistance provided by members 88*a* and 88*b* is not necessary if the biasing force of compression spring 72 is adequate. Also, one of ordinary skill will be able to vary the dimensions of the device so as to accommodate different length cartridge fuses. Accordingly, it is intended that the scope of protection granted by Letters Patent hereon be limited only by the definition contained in the appended claims and equivalents thereof.

I claim:

1. A combination fuse holder and switch comprising:

body means including a first receptacle means for receiving one contact end of an elongated fuse, said body means defining a channel communicating between said first receptacle means and an opening on said body means, a first terminal associated with said body means and having a first contact in said first receptacle means, and a second terminal associated with said body means and having an arm located in said channel, said arm having a second contact therein spaced from said first contact, switch means including a second receptacle means for retentively receiving a second contact end of said fuse, said switch means for moving said fuse transversely relative to the longitudinal axis thereof, means for placing said second contact end of said fuse in electrical contact with the exterior of said second receptacle means, holder means for said switch means for coupling said switch means to said body means so that the first contact end of said fuse is in electrical contact with the first contact in said first receptacle means, the second contact on the arm of said second terminal being so positioned relative to said second receptacle means and said second receptacle means being so constructed as to make and break contact with the second end of said fuse when said second receptacle means is moved transversely relative to said fuse axis by said switch means.

2. The combination fuse holder and switch of claim 1 wherein said fuse is a cartridge fuse and wherein the contact ends on said fuse are ferrule contacts, said second receptacle means including means for placing said second contact end of said fuse in electrical contact with an exterior contact on said second receptacle means, said second contact on said arm of said second terminal making and breaking contact with said exterior contact to thereby make and break contact with the second contact end of said fuse.

3. The fuse holder and switch of claim 2 wherein said second receptacle means is composed of an electrically conductive material, the interior of said second receptacle means being in electrical contact with the second end of said fuse, the exterior of said second receptacle means being said exterior contact.

4. The combination fuse holder and switch of claim 1 wherein said switch means moves said second receptacle means between a first position wherein the exterior contact on said second receptacle means and said second contact are in electrical contact and a second position wherein said electrical contact is broken, said switch means further comprising means for biasing said second receptacle means toward said first and second positions.

5. The combination fuse holder and switch of claim 1 wherein said first receptacle means and said first terminal contact are sized and constructed so that said first terminal contact functions as a fulcrum for said fuse as the second contact end of said fuse is moved transversely relative to the fuse axis by said switch means.

6. A combination cartridge fuse holder and switch, for a cartridge fuse having first and second ferrule contacts on respective ends thereof, comprising:

body means having first and second ends, said body means having a channel opening onto said first end and extending toward said second end, said second end having a cavity therein sized to receive a first ferrule contact of a cartridge fuse, one end of said cavity communicating with said channel, said body means including an end wall located at the second end of said body means, said end wall closing the other end of said cavity, a first terminal affixed to said body means and having a first terminal end exterior of said body means and having a cavity contact located at said other end of said cavity, a second terminal affixed to said body means and having a second terminal end exterior of said body means and having an arm extending into said channel said arm having an arm contact thereon located in said channel and spaced from said cavity contact, retention means for receiving a second ferrule contact of a cartridge fuse and mounting means associated with the first end of said body means for mounting said retention means for swinging movement from a first position adjacent said arm contact to a second position spaced from said arm contact, said retention means including means for placing said second ferrule contact into electrical contact with said arm contact when said retention means is in said first position, and actuating means for moving said retention means between said first and second positions.

7. The combination of claim 6 wherein said arm is flexible and resilient.

8. The combination of claim 7 wherein said channel comprises a cylindrical bore and wherein said mounting means comprising a switch holder having a cylindrical body portion telescopically engaging said cylindrical bore, said mounting means including means for retaining said cylindrical body portion in said cylindrical bore.

9. The combination of claim 8 further comprising:

biasing means associated with said actuating means for selectively biasing said retention means toward said first and second positions.

10. The combination of claim 8 wherein said retention means comprises:

a second receptacle means for retentively receiving the second ferrule contact of said fuse, including said means for placing said second ferrule contact in electrical contact with an exterior contact on said second receptacle means, said exterior contact making electrical contact with said arm contact when said retention means is in said first position.

11. The combination of claim 10 wherein said second receptacle means is composed of an electrically conductive material.

12. The combination of claim 8 wherein said mounting means and said actuating means further comprise:

a first arm pivotally mounted on said switch holder for pivotal motion about a substantially diametric axis relative to said cylindrical body portion, said switch holder having a first end terminating adjacent said first end of said body means and a second end terminating between said arm contact and said first end of said body means, said first arm having a first end located externally of said switch holder on one side of said diametric axis and a second end located on the opposite side of said diametric axis, a second arm and coupling means for pivotally coupling said second arm to said second end of said first arm by a pivot pin, said pivot pin being oriented substantially parallel to said diametric axis, said second arm being affixed to said retention means, said cavity and said first terminal contact being sized and constructed so that said first terminal contact functions as a fulcrum for said first ferrule contact of said cartridge fuse, thereby allowing said second ferrule to be moved transversely relative to the longitudinal axis of said fuse as said first arm is swung about said diametric axis.

13. The combination of claim 12 further comprising:

biasing means associated with said pivot pin and one of said first and second arms for biasing said arms away from each other in generally axial direction relative to said force, thereby biasing said retention means selectively toward said first and second positions.

14. The combination of claim 13 wherein said biasing means comprises:

a diametric and longitudinally extending slot in one of said first and second arms, said pivot pin being mounted for movement in said slot in a direction oriented longitudinally relative to said slot and transversely relative to the axis of said pin, and a compression spring mounted in said slot between said pin and said one of said first and second arms for biasing said pin toward one end of said slot and thereby biasing the other of said arms away from the first of said arms.

15. The combination of claim 12 further comprising:

detent means associated with said switch holder for retaining said first arm so that said retention means is held selectively in said first and second positions dependent upon the position of said first arm.

16. The combination of claim 12 wherein one end of said switch holder lies adjacent said first end of said body means and the other end of said switch holder lies adjacent the end of the arm of said second terminal, and wherein said retention means comprises:

a receptacle defining a cylindrical cavity for receiving a second ferrule contact of said cartridge fuse, said second arm being affixed to said receptacle, said switch holder including means defining a cavity therein extending from adjacent said diametric axis to the other end of said switch holder and being elongated in a diametric direction oriented generally orthogonally to said diametric axis, thereby restraining sideward movement of said first and second arms in a direction generally along said pivot axes.

17. The combination of claim 16 further comprising:

a guide pin mounted on said body means adjacent said first end thereof and extending radially inwardly into said cylindrical bore, said switch holder having a longitudinal guide groove constructed to meet with said guide pin, said groove extending from the other end of said switch holder to adjacent the one end of said switch holder said switch holder further having a circumferential guide groove joined to the longitudinal guide groove adjacent said one end, said circumferential guide groove having a detent in the terminus thereof spaced from said longitudinal groove for receiving said guide pin, said longitudinal and circumferential guide grooves being so positioned as to angularly offset said retention means from said second terminal arm as said switch holder is being telescoped into the cylindrical bore of said body means, and to align said retention means with said second terminal arm as said guide pin traverses said circumferential guide groove and seas in said detent at the terminus of said circumferential guide groove.

18. The combination of claim 16 further comprising:

biasing means associated with said pivot pin and one of said first and second arms for biasing said arms away from each other in generally axial direction relative to said force, thereby biasing said retention means selectively toward said first and second positions, and stop means associated with said cavity in said switch holder for preventing said first arm from moving toward said second arm against said biasing means when said retention means is in said first position.

* * * * *